US006051927A

United States Patent [19]

Graser et al.

[11] Patent Number: 6,051,927

[45] Date of Patent: Apr. 18, 2000

[54] HIGH PRESSURE SODIUM LAMP OF LOW POWER

[75] Inventors: Wolfram Graser, Munich; Dieter Schmidt, Berlin, both of Germany

[73] Assignee: Patent-Truehand-Gesellschaft fuer elektrische Gluelampen mbH, Munich, Germany

[21] Appl. No.: 08/941,941

[22] Filed: Oct. 1, 1997

[51] Int. Cl.[7] ..... H01J 17/20

[52] U.S. Cl. ..... 313/570; 313/571; 313/638; 313/639; 313/642; 313/643

[58] Field of Search ..... 313/570, 571, 313/638, 639, 642, 643

[56] References Cited

U.S. PATENT DOCUMENTS 4,260,929 4/1981 Jacobs et al. ..... 313/570

5,239,230 8/1993 Mathews et al. ..... 313/571

FOREIGN PATENT DOCUMENTS 0183247 11/1985 European Pat. Off. ..... H01J 61/12

0374678 6/1990 European Pat. Off. ..... H01J 61/22

2298185 1/1976 France ..... H01J 61/16

2387511 4/1978 France ..... H01J 61/12

*Primary Examiner*—Ashok Patel

*Attorney, Agent, or Firm*—William H. McNeill

[57] ABSTRACT

The high-pressure sodium discharge lamp of low power described here is characterized by a very high xenon cold filling pressure of at least 1 bar. The pressure ratio to the sodium operating pressures lies between 10 and 30. Luminous efficacies of approximately 100 lm/W and more can be obtained with a lamp power of 50 to 100 W.

14 Claims, 3 Drawing Sheets

HIGH PRESSURE SODIUM LAMP OF LOW POWER

TECHNICAL FIELD

The invention generally relates to a high-pressure sodium discharge lamp of low power. It particularly concerns high-pressure sodium discharge lamps with a power of at most 100 W and very high xenon pressure. Usually, such lamps have a cylindrical discharge vessel of aluminum oxide, which is accommodated in a transparent outer bulb.

BACKGROUND ART

The principles of the construction of high-pressure sodium discharge lamps are known. It has also been known for a very long time to use xenon at relatively high pressure in order to increase the luminous efficacy in these lamps. For example, ii is stated in the relevant monograph, "The High-Pressure Sodium Lamp" of DeGroot/VanVliet (Philips Technical Library, Deventer, 1986) on pages 299 and 300, that an increase in the luminous efficacy by 10 to 15% can be obtained, if—in so-called Super Lamps—a cold filling pressure for xenon of 20 to 40 kPa (200 to 400 mb) is used instead of the standard conventional filling pressure of approximately 30 mb.

It is indicated simultaneously on page 299 that the luminous efficacy greatly decreases in high-pressure sodium discharge lamps with decreasing lamp power. Also, with elevated xenon pressure, it amounts to 85 lumens per watt (lm/W) at most for a 50 W lamp power, whereas a luminous efficacy of approximately 138 lm/W can be obtained for a 400 W lamp power.

A Hg-free high-pressure sodium lamp particularly suitable for so-called self-stabilizing operation is described in German Patent 2,600,351, and this has a sodium operating pressure $p_{NaB}$ of between 4 to 93 mb, a xenon operating pressure $p_{Xe(hot)} \geqq 800$ mb and a pressure ratio $p_{NaB}/p_{Xe(hot)} \leqq 1/20$. Taking into consideration the usual factor 8 (German AS 2,814,882, column 2, center) for converting between xenon operating pressure and xenon cold filling pressure $p_{XeK}$, there results a pressure ratio $p_{XeK/pNaB} \leqq 2.5$. Under self-stabilizing operation, it is a desired goal to drive a high-pressure sodium lamp without a lamp ballast. A long decomposition time of the plasma formed from the filling gas is necessary for this mode of operation. In order to achieve this long decomposition time, as is known, a relatively high xenon pressure as well as a relatively large inner diameter of the discharge vessel is used (see also the above-mentioned pertinent monograph of DeGroot/VanVliet, pages 126 and 154). According to DeGroot/VanVliet, p. 155, the self-stabilizing operation of high-pressure sodium lamps has found no practical application due to problems in ignition and in sudden changes in the mains voltage.

The high-pressure sodium discharge lamp described as an example in German Patent 2,600,351 has a high power of 400 W and a very large inner diameter of 7.6 mm. The xenon cold filling pressure amounts to 260 mb and the pressure ratio $p_{XeK}/p_{NaB}$ is approximately 3.5. Thus, a rather moderate luminous efficacy of only 110 lm/W is obtained with a high power of 400 W. A particularly high luminous efficacy is neither aimed at nor achieved in this publication in comparison to other high-pressure sodium lamps. According to FIG. 10.18 of DeGroot/VanVliet (p. 299), luminous efficacies of up to 138 lm/W can be obtained for 400 W powers. This dependence in principle of luminous efficacy on lamp power is shown for purposes of comparison as FIG. 3 (see below).

A Hg-free high-pressure sodium lamp without self-stabilization is described in German AS 2,814,882. A value between $1.25 < p_{XeK}/p_{NaB} < 6$ with $p_{NaB}$=150 to 500 mb is recommended for the xenon cold filling pressure $p_{XeK}$ relative to the sodium operating pressure ($p_{NaB}$=sodium operating pressure). This value moreover agrees quite well with the value described in German Patent 2,600,351 for the pressure ratio $p_{XeK}/p_{NaB}$. However, a further increase of the xenon pressure above this upper limit is not recommended in German AS 2,814,882 (column 3, lines 41f), since the disadvantage of a more difficult ignition results, "without a corresponding increase in luminous efficacy". In the examples with low lamp powers of 70 and 100 W, $p_{NaB}$=230 mb, the xenon cold filling pressure is approximately 500 mb. This corresponds to a pressure ratio $p_{XeK}/p_{NaB}$ of approximately 2 to 2.5. Therefore, a luminous efficacy of 97 to 105 lm/W is obtained at 70 or 100 W. These values are plotted for comparison as the x's in FIG. 3 (see below).

DISCLOSURE OF THE INVENTION

It is an object of the present invention to provide a high-pressure sodium discharge lamp of low power which has a high luminous efficacy.

This task is resolved by the characterizing features of claim 1. Particularly advantageous embodiments are found in the dependent claims.

The high-pressure sodium discharge lamp of low power according to the invention has a discharge vessel, which contains at least sodium and xenon. Low power is to be understood particularly as lamp power that is lower than or equal to 100 W.

$p_{NaB}$ is the operating filling pressure of sodium and $p_{XeK}$ is the cold filling pressure of xenon. Surprisingly, with low power and counter to prior dogma, a further increase in luminous efficacy by typically 20% can be obtained, if $p_{NaB}$ is selected equal to 20 to 100 mb and $p_{XeK}$=1 to 5 bars, and also if the condition $p_{pXeK}/p_{NaB} \leqq 10$ is simultaneously maintained. Advantageously, the pressure ratio $p_{XeK}/p_{NaB}$ lies between 10 and 30.

In order to increase the arc-drop voltage, mercury can be added to the lamp filling.

The xenon pressure exceeds the values usual for previously known high-pressure sodium discharge lamps with high xenon pressure (for example, the NAV SUPER lamps of the OSRAM Company) by a factor of 3 to 10. Thus a luminous efficacy that is typically increased by 20% results when compared to these NAV Super lamps.

The already mentioned previously known increase in luminous efficacy of high-pressure sodium lamps with an increase in xenon pressure (see DeGroot/VanVliet, p. 153 and pp. 299–300) is commercially utilized in so-called NAV SUPER lamps. The increase in luminous efficacy obtained with the present invention in the case of a further increase in xenon pressure is unexpectedly high in comparison to the values in NAV SUPER lamps and was not known to this extent. Thus, e.g., in DeGroot/VanVliet, p. 300, a luminous efficacy that was increased by 10 to 15% relative to so-called standard lamps (30 mb xenon cold filling pressure) is described, for example, with an increase in xenon filling pressure (cold) to 200 to 400 mb. A further increase in pressure is excluded therein due to the more difficult ignition.

The surprising behavior of the lamps of the invention is based on the targeted utilization of a situation that was not previously considered by experts in the field. It is known in fact that the luminous efficacy of high-pressure sodium lamps clearly decreases for low lamp powers (DeGroot/VanVliet, p. 299; see FIG. 3 below). The explanation given therein is that the circumstance responsible for this regularity is that the efficiency of radiation is smaller in the case of low lamp power and electrode losses are higher than in the case of higher lamp powers. However, this is incorrect. The primary reason is rather that the relative component of heat loss in the discharge arc for the lamp power is greater with decreasing lamp power. This heat loss can be reduced, however, by the low heat conductivity of xenon, if it is used with sufficiently high pressure as a buffer gas. This effect operates more favorably on the luminous efficacy, the lower the lamp power is. The decisive factor is the pressure ratio between xenon and sodium, since sodium, unlike xenon, has a high heat conductivity. The higher the xenon pressure relative to the sodium pressure, the better the heat losses can be attenuated. As a final effect, this leads to the observed additional increase of luminous efficacy for small lamp powers.

The very high xenon pressure of at least 1 bar (cold) has still other advantages along with the increase in luminous efficacy:

1. A lower wall temperature of the discharge vessel can be achieved due to the smaller heat loses. This can be utilized, for example, for prolonging the service life. Alternatively, the discharge vessel can be reduced in size, so that the initially present will temperature is again achieved. Due to the higher power density, the luminous efficacy increases still further.

2. The high xenon pressure hinders diffusion. This decreases the evaporation of the electrode components during the ignition process and reduces the blackening of the wall of the discharge vessel that results therefrom in the region of the electrodes. This effect is known qualitatively from NAV SUPER lamps. With very high xenon pressure, it is pronounced even more intensely, whereby the service life will be further prolonged.

3. In the case of the lamps of the invention, due to its very high pressure, xenon supplies a considerable contribution to the arc-drop voltage. This contribution is independent of the temperature of the discharge vessel, since the xenon is present in gas form in contrast to sodium also at room temperature. This acts in a stabilizing manner relative to fluctuations in the mains voltage or manufacturing spread. In contrast to this, for all previously known lamps (for example, according to German AS 2,814,882), the contribution of xenon atoms to the arc-drop voltage is insignificant. The arc-drop voltage is determined therein almost only by the number of sodium atoms, which is greatly influenced by the temperature of the coldest point (cold spot) and thus by fluctuations in the mains voltage or manufacturing spread. In the case of a mercury addition, this is also effective in adjusting the arc-drop voltage.

4. A particularly low re-ignition peak results in the lamp operation due to the very high xenon pressure. This extends the service life due to the smaller load on the electrodes and provides greater security relative to extinguishing the lamp due to sudden fluctuations in mains voltage.

5. In the sodium spectrum, xenon causes a broadening of the peak tip distance in the spectral profile of the pressure-expanded sodium resonance line that is self-absorbed in its center (D line). This effect is known in principle (see DeGroot/VanVliet, particularly p. 16a, plate 1c). The sodium pressure can be decreased in this way with the same color temperature and color reproduction. This effect is very vigorous with high xenon pressure of at least 1 bar (cold). In the case of the present invention, in a particularly favorable manner, the sodium pressure is adjusted so low, in the ratio to xenon pressure, that a tip distance for the two parts of the resonance line, typically of 10 nm, and 12 nm at most, results. An essential prerequisite for this is that the ratio $p_{XeK}/p_{NaB}$ is selected $\geqq 10$ and $p_{NaB}$=20 to 100 mb.

It has turned out that under these conditions, optimal luminous efficacies arise. On the other hand, in the case of the ratios given in German AS 2,814,882, there 's a peak distance between the two parts of the sodium D line of at least 15 to 20 nm, since $p_{NaB}$ is relatively high there (see above). This can be estimated by means of equation (3.28) given in DeGroot/VanVliet, p. 87.

An additional justification for the selection of the typically low operating pressure of the sodium vapor of 20 to 100 mb that is typical of the present invention results from items 3 and 5. This low sodium pressure has in turn several advantages:

1. For a sodium vapor pressure of 20 to 100 mb, the temperature of the discharge vessel at the coldest point (cold spot) amounts to only 840 to 950 K. This coldest spot always lies in the vicinity of the seal. Thus, the seal is typically approximately 150 K colder than in previously known lamps (see German AS [Examined] 2,814,882), for which reason, there is a reduction in lamp failures due to leaks in the region of the seal.

2. The corrosion of the wall of the discharge vessel, which is due to sodium and which occurs preferentially in the center of the vessel, is reduced due to the low sodium partial pressure. In this way, there results an additional increase in service life.

The disadvantage of a more difficult ignitability mentioned in German AS 2,814,882 can be directly countered in the case of low lamp powers ($\leqq$100 W) by the use of improved, commercially available bases, sockets, and ignition devices, as long as the xenon pressure is not too high (over 5 bars). Advantageously, the xenon pressure is limited to values of up to 3 bars. These improved parts are already utilized in commercially available metal halide lamps of the OSRAM company (e.g., HQI-E 100 W/NDL and WDL). An ignition with conventional ignition devices for NAV lamps of low power, on the other hand, is not possible for lamps of the present invention.

In contrast to German Patent 2,600,351, the lamps described herein are neither intended for nor suitable for self-stabilizing operation. The xenon operating pressure of 8 to 24 bars, which is obtained according to the invention, is essentially higher than the typical value of 1.8 bar that is given therein.

The heating of the discharge vessel, which is described in German Patent 2,600,351, and which is necessary there for starting (alternatively, a conventional lamp ballast can be utilized), is not necessary in the discharge vessel of the invention. The discharge vessel of the invention preferably has an appendix (initially an open niobium tube), through which high-pressure xenon can be filled in the known way, and which is sealed after the filling process.

The lamps of the invention may contain mercury in the filling in addition to sodium and xenon. The increase in luminous efficacy for lamps with and without a mercury addition is roughly the same. An amalgam with 18 wt. % Na is used as a typical lamp filling with a mercury addition.

Preferably, the inner diameter of the discharge vessel amounts to between 2.5 and 5 mm, particularly 4 mm at most. For these dimensions, a self stabilization is excluded from the outset. For comparison: the inner diameters given in German Patent 2,600,351 are larger by an entire order of magnitude. In general, the discharge vessel is circular-cylindrical, but it also can have another geometry; for example, it can bulge out in the center.

Advantageously, high-pressure sodium lamps also have a capacitive ignition means, e.g., a wire along the discharge vessel. In contrast to German Patent 2,600,351, the lamps of the invention do not require preheating.

These lamps frequently have a niobium tube appendix, as it is described, for example, in DeGroot/VanVleit on page 251, FIG. 8.30.

The operation of such lamps is possible with a conventional lamp ballast or frequently also with an electronic lamp ballast.

The discharge vessels described here are preferably inserted in outer bulbs.

The invention will be explained in more detail in the following on the basis of several examples of embodiment.

DESCRIPTION OF THE PREFERRED EMBODIMENTS

Figure 1:
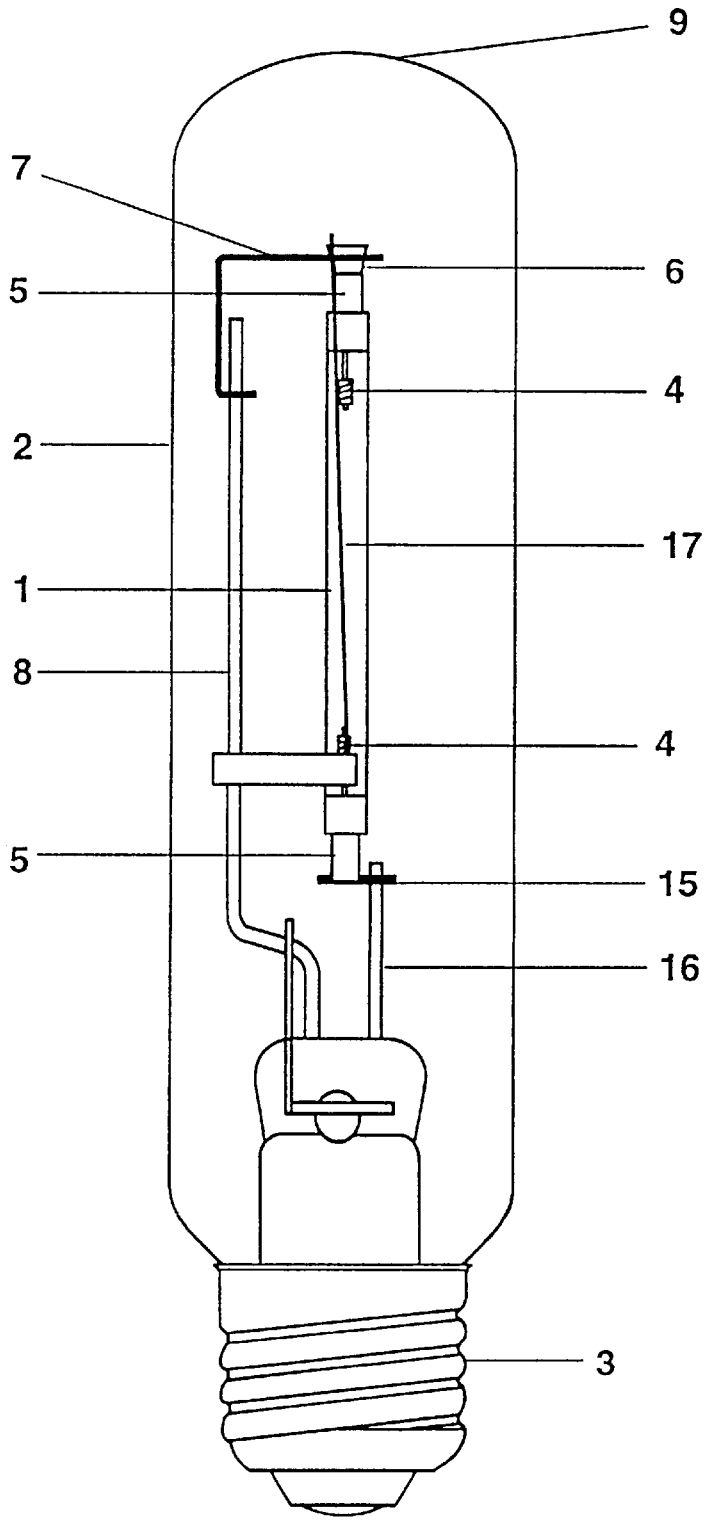
FIG. 1 shows a high-pressure sodium discharge lamp.

The high-pressure sodium discharge lamp shown in FIG. 1 with a power of 50 W has a discharge vessel 1 made of substantially aluminum oxide. It is arranged in a cylindrical outer bulb 2 of hard glass, which is closed at its first end by a screw base 3 and at its second end with a curved part 9. Outer bulb 2 is evacuated.

Two electrodes 4 stand opposite each other with an electrode distance EA of 30 mm in discharge vessel 1 with an inner diameter of 3.3 mm. The first electrode 4, which is away from the base, is connected by means of a tube-shaped niobium leadthrough 5 with appendix 6 with a lead 7, which is connected to a solid outer current lead 8, which leads along the discharge vessel to a contact in screw base 3.

The second electrode 4 is also connected by means of a niobium leadthrough 5 (but without appendix) to a metal wire 15. This wire is connected by means of a second conductor 16 to a second contact in base 3.

The discharge vessel is equipped with a capacitive ignition means, which is formed by an ignition wire 17 along the discharge vessel. Ignition wire 17 is connected is an electrically conducting manner with second electrode 4.

The lamp is connected, for example, by means of an ignition circuit in the lamp base, to an a.c. voltage network with 220 V. The ignition voltage is 4 kV.

Discharge vessel 2 contains a filling, which comprises sodium and xenon. The cold filling pressure of xenon ($p_{XeK}$) amounts to 3 bars, and the operating filling pressure of sodium ($p_{NaB}$) is 100 mb, so that $p_{XeK}/(p_{NaB})=30$.

Figure 2:
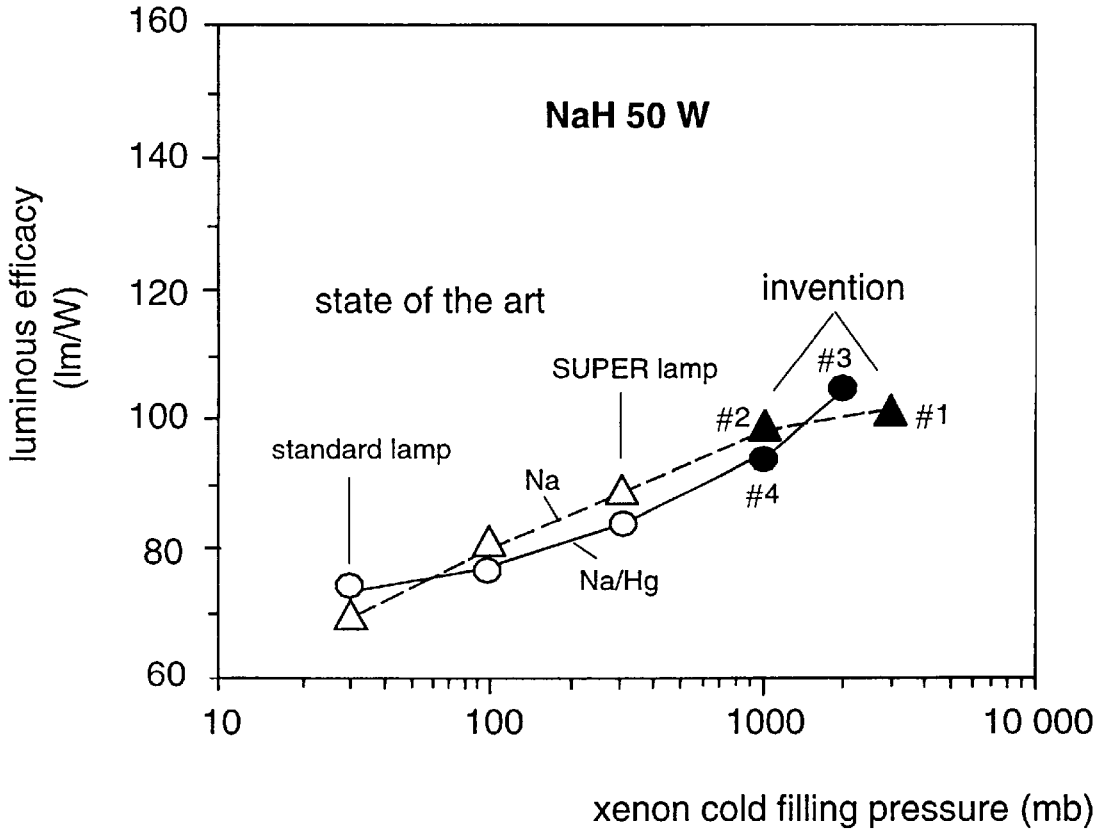
FIG. 2 shows a comparison of the luminous efficacies of different high-pressure sodium lamps (each with a power of 50 W) with variable xenon pressure (with and without Hg)

This lamp reaches a luminous flux of 5100 lm and a luminous efficacy of 102 lm/W (see FIG. 2, solid triangle measurement point #1 in the case of 3000 mb xenon cold filling pressure). In comparison to this, previous 50 W lamps with a xenon cold filling pressure of 300 mb (SUPER type) only have a luminous flux of 4200 lm corresponding to a luminous efficacy of 81 lm/W (see FIG. 2, open triangle measurement point). The luminous efficacy for other lamps with the usual low xenon pressure of 100 mb at most (standard type) is also indicated in FIG. 2. It amounts to approximately 70 lm/W at 30 mb (see FIG. 2, open triangle measurement points).

Figure 3:
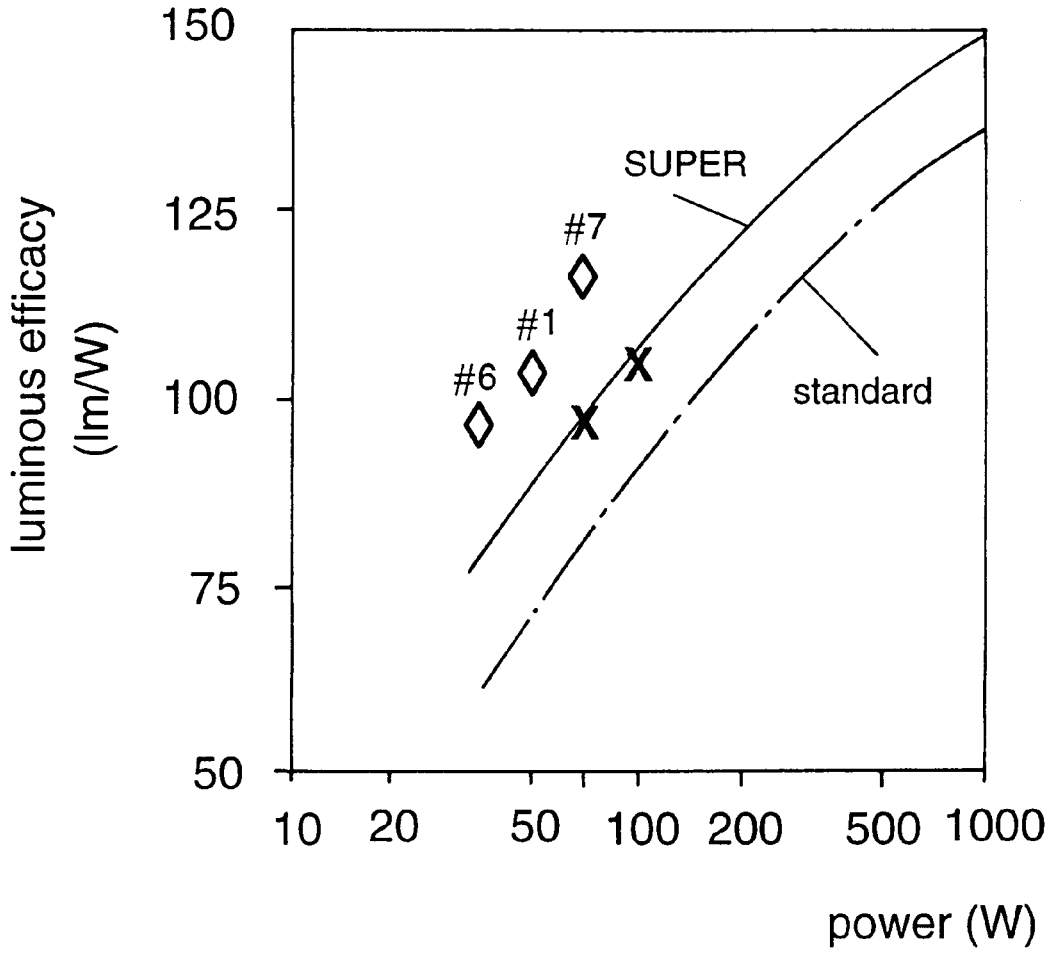
FIG. 3 shows a comparison of the luminous efficacies of different high-pressure sodium lamps for different lamp powers and different xenon pressure.

The dependence of luminous efficacy on lamp power is presented schematically in FIG. 3 on the basis of DeGroot/VanVliet. The value obtained with the above example (102 lm/W for 50 W lamp power) is plotted as a diamond-shaped measurement point [#1]. It lies clearly above the state of the art.

In a SECOND embodiment, a lamp that is similar in construction is operated with only 1 bar of xenon pressure and 50 mb of sodium pressure. Here, the ratio $p_{XeK}/p_{NaB}=20$. The luminous efficacy of 95 lm/W is always clearly higher than in previously known lamps (see FIG. 2, solid triangle measurement point #2 for 1000 mb xenon cold filling pressure). Due to the lower xenon pressure, ignition is facilitated when compared with the first example of embodiment. The ignition voltage is 3 kV.

These two lamps are particularly suitable for new units with stronger ignition devices.

In a THIRD embodiment, the 50 W lamp that is similar in construction is also filled with mercury. An amalgam containing 18 wt. % sodium, with the remainder of mercury, is used for this purpose. This lamp shows a luminous efficacy of 105 lm/W (solid circle measurement point #3 in FIG. 2) for 2 bars of xenon cold filling pressure, 80 mb of sodium operating pressure, and a pressure ratio $p_{XeK}/p_{NaB}=25.0$ A FOURTH embodiment (50 W) with 1 bar of xenon cold filling pressure with the same Na/Hg ratio shows correspondingly a luminous efficacy of 93 lm/W (solid circle measurement point #4 in FIG. 2).

For comparison, the corresponding luminous efficacies of mercury-containing sodium lamps with lower xenon cold filling pressure (SUPER and standard types are also given (open circle measurement points for 30 to 300 mb in FIG. 2).

In a FIFTH embodiment an essentially similar lamp with 63 W power is operated. The filling contains 1 bar xenon and 50 mb sodium, but no mercury. The pressure ratio $p_{XeK}/p_{NaB}=20$. The luminous efficacy amounts to 98 lm/W. This lamp is designed as a direct replacement for high-pressure mercury lamps with 125 W power, which have the same luminous flux. It has a power reduction circuit (phase control) and an ignition circuit in the lamp base.

In a SIXTH embodiment of a 35 W lamp, a discharge vessel with an inner diameter of 3.3 mm and an electrode distance of 23 mm is filled only with sodium and xenon. The xenon cold filling pressure amounts to $p_{XeK}=2$ bars, and the sodium operating pressure is $p_{NaB}=90$ mb.

Correspondingly, the pressure ratio $p_{XeK}/p_{NaB}=22.2$. The luminous efficacy is 98 lm/W (see FIG. 3, diamond-shaped measurement point #6) and thus lies essentially higher than was previously expected for lamps of this power.

In a SEVENTH embodiment of a 70 W lamp, a discharge vessel with an inner diameter of 3.3 mm and an electrode distance of 36 mm is filled with sodium/mercury amalgam (see above) and xenon. The xenon cold filling pressure amounts to $p_{XeK}=2$ bars, and the sodium operating pressure is $p_{NaB}=75$ mb. Correspondingly, the pressure ratio $p_{XeK}/p_{NaB}=26.7$. The luminous efficacy is 115 lm/W (see FIG. 3, diamond-shaped measurement point #7) and thus also lies clearly higher than was previously expected for lamps of this power.

In an EIGHTH embodiment of a 70 W lamp, a discharge vessel with an inner diameter of 3.7 mm and an electrode distance of 37 mm is filled with sodium/mercury and xenon. The xenon cold filling pressure amounts to $p_{XeK}$=1.5 bars, and the sodium operating pressure is $p_{NaB}$=85 mb. Correspondingly, the pressure ratio $p_{XeK}/p_{NaB}$=17.6. The luminous efficacy is 108 lm/W.

What is claimed is:

1. High-pressure sodium discharge lamp of low power with a discharge vessel, which contains at least sodium and xenon and is free of mercury, in which $p_{NaB}$ is the operating filling pressure of sodium and $p_{XeK}$ is the cold filling pressure of xenon, is characterized in that $p_{NaB}$=20 to 100 mb, $p_{Xek}$=1 to 5 bars and, $p_{XeK}/p_{NaB} \geqq 10$, and the lamp power is 100 watts or less.

2. High-pressure sodium discharge lamp according to claim 1, further characterized in that $p_{XeK}/p_{NaB} \leqq 30$.

3. High-pressure sodium discharge lamp according to claim 1, further characterized in that $p_{XeK} \leqq 3$ bars.

4. High-pressure sodium discharge lamp according to claim 1, further characterized in that the discharge vessel is circular-cylindrical.

5. High-pressure sodium discharge lamp according to claim 4, further characterized in that the inner diameter of the discharge vessel amounts to between 2.5 and 5 mm.

6. High-pressure sodium discharge lamp according to claim 5, further characterized in that the inner diameter amounts to 4 mm at most.

7. High-pressure sodium discharge lamp according to claim 1, further characterized in that the lamp also contains a capacitive ignition means.

8. High-pressure sodium discharge lamp according to claim 1, further characterized in that the tip distance between the two parts of the sodium D line amounts to 12 nm at most in operation.

9. High-pressure sodium discharge lamp of low power with a discharge vessel, said vessel containing sodium, mercury and xenon, in which $p_{NaB}$ is the operating pressure of sodium and $p_{XeK}$ is the cold filling pressure of xenon, which is characterized in that $p_{NaB}$=20 to 100 mb, $p_{Xek}$=1 to 5 bars, and $p_{XeK}/p_{NaB} \geqq 10$, And the lamp power is less than or equal to 100 watts;

the discharge vessel is circular-cylindrical; and the inner diameter of the discharge vessel is between 2.5 and 5 mm.

10. High-pressure sodium discharge lamp of claim 9, further characterized in the $p_{XeK}/p_{NaB} \leqq 30$.

11. High-pressure sodium discharge lamp of claim 9, further characterized in that $p_{XeK} \leqq 3$ bars.

12. High-pressure sodium discharge lamp according to claim 9, further characterized in that the inner diameter does not exceed 4 mm.

13. High-pressure sodium discharge lamp according to claim 9, further characterized in that the lamp also contains a capacitive ignition means.

14. High-pressure sodium discharge lamp of claim 9, further characterized in that the tip distance between the two parts of the sodium D line mounts to 12 mm at most in operation.

* * * * *